US010701789B2

(12) United States Patent
Park et al.

(10) Patent No.: US 10,701,789 B2
(45) Date of Patent: Jun. 30, 2020

(54) METHOD FOR DRIVING X-RAY SOURCE

(71) Applicant: ELECTRONICS AND TELECOMMUNICATIONS RESEARCH INSTITUTE, Daejeon (KR)

(72) Inventors: Sora Park, Seoul (KR); Yoon-Ho Song, Daejeon (KR); Jin-Woo Jeong, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 155 days.

(21) Appl. No.: 15/879,323

(22) Filed: Jan. 24, 2018

(65) Prior Publication Data

US 2018/0213632 A1 Jul. 26, 2018

(30) Foreign Application Priority Data

Jan. 25, 2017 (KR) ..... 10-2017-0012299
Dec. 14, 2017 (KR) ..... 10-2017-0172654

(51) Int. Cl.
*H01J 35/08* (2006.01)
*H05G 1/22* (2006.01)
(Continued)

(52) U.S. Cl.
CPC ..... *H05G 1/22* (2013.01); *H01J 35/08* (2013.01); *H01J 35/12* (2013.01); *H05G 1/52* (2013.01);
(Continued)

(58) Field of Classification Search
CPC .. A61B 6/00; A61B 6/40; A61B 6/405; A61B 6/44; G05F 1/00; G05F 1/10;
(Continued)

(56) References Cited

U.S. PATENT DOCUMENTS 9,717,469 B2 8/2017 Harada
2004/0022360 A1* 2/2004 Price ..... H01J 35/065 378/121
(Continued)

FOREIGN PATENT DOCUMENTS

JP 2014061287 A 4/2014
JP 201461738 A 9/2014
(Continued)

OTHER PUBLICATIONS

Shan et al. "Anode thermal analysis of high power microfocus CNT x-ray tubes for in vivo small animal imaging," Proc. SPIE 8313, Medical Imaging 2012; Physics of Medical Imaging, p. 831300-1-831300-9 (Year: 2012).*

*Primary Examiner* — David P Porta
*Assistant Examiner* — Mamadou Faye

(57) ABSTRACT

Provided is a method for driving an X-ray source, which includes a cathode electrode, an electron source provided on the cathode electrode and configured to emit an electron beam, and an anode target including an electron beam irradiation surface with the electron beam irradiated thereto, the method including providing the electron beam in a plurality of main pulses, wherein each of the main pulses includes a plurality of short pulses having an idle time and a pulse time, and each of the idle time and the pulse time is shorter than a duration time of the main pulse, wherein applying the plurality of short pulses comprises irradiating the electron beam from the electron source towards the electron beam irradiation surface during the pulse time; and idling the electron beam during the idle time, wherein a duty cycle of the short pulse is 0.4 to 0.6, which is obtained by dividing the idle time by a sum of the pulse time and the idle time.

5 Claims, 3 Drawing Sheets

(51) Int. Cl.

| | |
|---|---|
| ***H05G 1/52*** | (2006.01) |
| ***H01J 35/12*** | (2006.01) |
| *H05G 1/54* | (2006.01) |

(52) U.S. Cl.
CPC . *H01J 2235/081* (2013.01); *H01J 2235/1225* (2013.01); *H05G 1/54* (2013.01)

(58) Field of Classification Search
CPC ..... H01J 35/00; H01J 35/02; H01J 35/025; H01J 35/22; H05G 1/00; H05G 1/02; H05G 1/04; H05G 1/06; H05G 1/08; H05G 1/085; H05G 1/10; H05G 1/20; H05G 1/22; H05G 1/24; H05G 1/62
See application file for complete search history.

(56) References Cited

U.S. PATENT DOCUMENTS

| | | | | |
|---|---|---|---|---|
| 2013/0051532 | A1* | 2/2013 | Caiafa ..... | H01J 35/18 378/110 |
| 2014/0241498 | A1 | 8/2014 | Jeong et al. | |
| 2016/0095568 | A1 | 4/2016 | Takanaka et al. | |
| 2017/0048955 | A1 | 2/2017 | Jeong et al. | |
| 2017/0053771 | A1 | 2/2017 | Jeong et al. | |

FOREIGN PATENT DOCUMENTS

| | | | |
|---|---|---|---|
| JP | 2016073449 | A | 5/2016 |
| KR | 10-1140993 | B1 | 5/2012 |
| KR | 10-2016-0091219 | A | 8/2016 |
| WO | WO 2013/069826 | A1 | 5/2013 |

* cited by examiner

METHOD FOR DRIVING X-RAY SOURCE

CROSS-REFERENCE TO RELATED APPLICATIONS

This U.S. non-provisional patent application claims priority under 35 U.S.C. § 119 of Korean Patent Application No. 10-2017-0012299, filed on Jan. 25, 2017, and No. 10-2017-0172654, filed on Dec. 14, 2017, the entire contents of which are hereby incorporated by reference.

BACKGROUND

The present disclosure herein relates to a method for driving an X-ray source, and more particularly, to a method for driving an X-ray source that irradiates an electronic beam by short pulse driving.

At the time of driving an X-ray source using an electron beam emitted from an electron source, an anode target surface is heated by an accelerated electron beam reaching an anode target. In this case, the power of the electronic beam and an X-ray dose are limited by a thermal limit of an anode target material. In an existing X-ray source, the anode target may rotate in order to overcome such a limit. Accordingly, a region at which the electron beam arrives may be widened not in a spot type, but in a track type, and heat by electron beam energy on the anode target surface may be dispersed. In this case, it is disadvantageous in that high dose driving is limited because of a rotation driving limit of the anode target, and an X-ray image property is even lowered by rotational vibration.

SUMMARY

The present disclosure provides a method for driving an X-ray source capable of preventing a temperature of an electron beam irradiation surface from being exceeding a melting point of an anode target and of meeting an X-ray dose requirement.

An embodiment of the inventive concept provides a method for driving an X-ray source, which includes a cathode electrode, an electron source provided on the cathode electrode and configured to emit an electron beam, an anode target including an electron beam irradiation surface with the electron beam irradiated thereto, the method including: providing the electron beam in a plurality of main pulses, wherein each of the main pulses includes a plurality of short pulses having an idle time and a pulse time, and each of the idle time and pulse time is shorter than a duration time of the main pulse, wherein applying the plurality of short pulses comprises irradiating the electron beam from the electron source towards the electron beam irradiation surface during the pulse time; and idling the electron beam during the idle time, wherein a duty cycle of the short pulse is 0.4 to 0.6 where the duty cycle is obtained by dividing the idle time by a sum of the pulse time and the idle time.

In an embodiment, the pulse time may be several nanoseconds (ns) to several seconds (s).

In an embodiment, in the duration time of the main pulses, a difference between a temperature increase of the electron beam irradiation surface during the pulse time and a temperature decrease of the electron beam irradiation surface during the idle time may be 5% or lower of a melting point in absolute temperature of the anode target.

In an embodiment, the anode target may include copper (Cu) or silver (Ag).

In an embodiment, the anode target may include tungsten (W), molybdenum (Mo), chromium (Cr), tantalum (Ta), or rhenium (Re).

In an embodiment, the X-ray source device may further include a gate electrode, and wherein the method further comprises controlling a gate voltage of the gate electrode to control emission of the electron beam in several nanoseconds (ns) to several seconds (s).

BRIEF DESCRIPTION OF THE FIGURES

The accompanying drawings are included to provide a further understanding of the inventive concept, and are incorporated in and constitute a part of this specification. The drawings illustrate exemplary embodiments of the inventive concept and, together with the description, serve to explain principles of the inventive concept. In the drawings.

DETAILED DESCRIPTION

Figure 1:
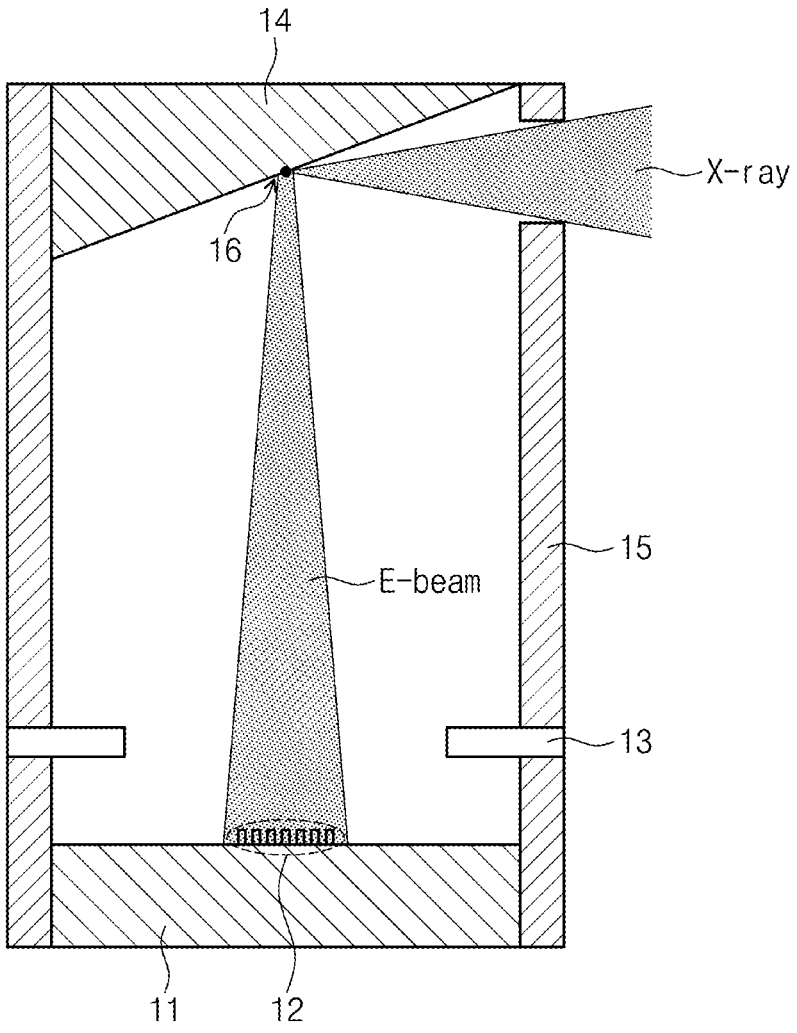
FIG. 1 is a cross-sectional view of an X-ray source device according to an embodiment of the inventive concept.

The above and other aspects, features, and advantages of the present disclosure will become apparent from the detailed description of the following embodiments in conjunction with the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art, and the present disclosure will only be defined by the appended claims. Like reference numerals indicate like elements throughout the specification and drawings.

The terminology used herein is for the purpose of describing particular embodiments only and is not intended to limit the scope of the present disclosure. As used herein, the singular forms "a", "an" and "the" are intended to include the plural forms as well, unless the context clearly indicates otherwise. It will be further understood that the terms "comprises," "comprising," "includes" and/or "including," when used in this specification, specify the presence of stated features, integers, operations, elements, and/or components, but do not preclude the presence or addition of one or more other features, integers, steps, operations, elements, components, and/or groups thereof.

Hereinafter, embodiments of the present disclosure will be described in detail.

FIG. 1 is a cross-sectional view of an X-ray source device according to an embodiment of the inventive concept.

Referring to FIG. 1, the X-ray source device according to the embodiment of the present invention includes a cathode electrode 11, an electron source 12, an anode target 14, and a vacuum container 15.

The cathode electrode 11 and the anode target 14 are located to face each other, and the anode target 14 may be separated by a prescribed distance from the cathode electrode and located over the cathode electrode 11. A bottom surface of the anode target 14, namely, the surface facing the cathode electrode 11 may be inclined at a prescribed angle.

The electron source 12 is provided on the cathode electrode 11. For example, the electron source 12 may be a carbon nanotube emitter and arranged in a dot array type.

The vacuum container 15 may be provided between the cathode electrode 11 and the anode target 14, and may be a tube type. Since the electron beam (E-beam) is generated and accelerated in a vacuum atmosphere, an X-ray source is required to be completely sealed or consistently maintain internal vacuum degree through a vacuum pump. Accordingly, the vacuum container 15 may be formed of a material of which a high voltage property is excellent, for example, ceramic, aluminum oxide, aluminum nitride, or glass, etc.

The X-ray source device according to the inventive concept may further include a gate electrode 13 including an opening at a position corresponding to the electron source 12. The gate electrode 13 will be described later.

When the X-ray source device is driven according to the above-described structure, an electron beam is emitted from the electron source 12. The electron beam is accelerated by an acceleration voltage applied to the anode target 14, and is irradiated onto the electron beam irradiation surface 16 of the anode target 14 to generate an X-ray.

When using such an X-ray in an X-ray imaging device, an X-ray dose may be determined according to the property of an object irradiated with the X-ray and a required image resolution. In this case, X-ray source driving conditions such as a current magnitude, an acceleration voltage and a duration time of the electron beam may be limited by the required X-ray dose and a melting point of the anode target 14.

$$E=V\cdot I\cdot t \tag{1}$$

Equation (1) may explain relationships among thermal energy E transferred by an electron beam to the anode target 14, an electron beam acceleration voltage V applied to the anode target 14, the current magnitude I of the electron beam, and a duration time t of the electron beam. In other words, the thermal energy E transferred by the electron beam to the anode target 14 may be calculated by multiplying the electron beam acceleration voltage V by the current magnitude I of the electron beam and the duration time t of the electron beam.

$$\Delta T=E/C \tag{2}$$

Equation (2) may explain relationships among thermal energy E transferred to the anode target 14, a thermal capacity C of the anode target 14, and a temperature change ΔT of the anode target 14 by electron beam irradiation. In other words, the temperature change ΔT of the anode target 14 may be calculated by dividing the transferred thermal energy E by the thermal capacity C.

When a high X-ray dose is required, the electron beam current magnitude I and the electron beam duration time t are required to be increased so as to satisfy the X-ray dose requirement. Accordingly, the thermal energy E transferred to the anode target 14 may be increased, and the temperature change ΔT is increased to raise a temperature of the anode target 14 over the melting point, which results damage to the X-ray source device.

In order to prevent the temperature of the anode target 14 from being raised over the melting point, the thermal capacity C may be enlarged by enlarging the size of the anode target 14, but the X-ray source size may also be enlarged to result in a complex structure.

In addition, the thermal energy E transferred to the anode target 14 by the electron beam irradiated by the electron source 12 does not uniformly raise the entire temperature of the anode target 14. In other words, since the thermal energy E is intensively transferred to the electron beam irradiation surface 16 on which the electron beam is irradiated and then transferred to other parts, the temperature of the electron beam irradiation surface 16 is the highest at the time of being irradiated with the electron beam. Therefore, it is important whether the temperature of the electron beam irradiation surface 16 on which the electron beam is irradiated rises over the melting point of the anode target 14.

In order to explain a temperature change in the electron beam irradiation surface 16, a concept of a thermal diffusivity α of the anode target 14 will be explained.

$$\alpha=\kappa/(\rho\cdot C_p) \tag{3}$$

Equation (3) explains a relationship among a thermal diffusivity α, a thermal conductivity κ, a density ρ, and specific heat Cp of the anode target 14. In this way, since the thermal diffusivity α of the anode target 14 is determined according to properties of the thermal conductivity κ, the density ρ, and the specific heat Cp of the anode target 14, the thermal diffusivity α of the anode target 14 may be raised by selecting a suitable material. For example, a material of large specific heat Cp or a material of large thermal conductivity κ may be selected. When the thermal diffusivity α of the anode target 14 increases, the thermal energy E transferred to the anode target 14 is transferred faster to other parts on the electron beam irradiation surface 16. Accordingly, the temperature of the electron beam irradiation surface 16 irradiated with the electron beam may be further slowly increased. Therefore, when a suitable material of high thermal diffusivity α is selected, the temperature of the electron beam irradiation surface 16 may be prevented from rising over the melting point of the anode target 14. For example, copper (Cu) or silver (Ag) of high thermal diffusivity α may be selected as the anode target 14.

In addition, a material having a high melting point is selected as the anode target to prevent the temperature of the electronic beam irradiation surface 16 from rising over the melting point of the anode target 14. For example, tungsten (W), molybdenum (Mo), chromium (Cr), tantalum (Ta), or rhenium (Re) having a high melting point may be selected as the anode target 14.

Beside, cobalt (Co), iron (Fe), or yttrium (Y) may also be selected as the anode target 14.

In addition, through a control of the structure of the anode target 14, the temperature of the electronic beam irradiation surface 16 may be prevented from rising over the melting point of the anode target 14. Like tungsten (W), when the thermal conductivity κ of the material of the anode target 14 is low, as the anode target 14 is thicker, a speed of transference of the energy E to other parts of the anode target 14 from the electron beam irradiation surface 16 is slower. Accordingly the temperature of the electron beam irradiation surface 16 may increase faster. In this case, when the thickness of the anode target 14 is made relatively thinner, and a material such as copper (Cu) or silver (Ag) with high thermal conductivity κ is attached to a rear surface (the opposite surface of the electron beam irradiation surface 16) of the anode target 14, the thermal energy E transferred to the electron beam irradiation surface 16 is transferred faster to the material attached to the rear surface of the anode target 14. Consequently, the temperature of the electron beam irradiation surface 16 may be further slowly increased.

A temperature increase in the electron irradiation surface 16 of the anode target 14 may be differed by the area of the electron beam irradiation surface 16. When other conditions are the same, as the area of the electron irradiation surface becomes smaller, the thermal energy E transferred per unit area becomes bigger and the temperature of the electron beam irradiation surface 16 increases faster.

In order to obtain an X-ray image of high resolution, the area of the electron irradiation surface 16 is required to be relatively small, and thus a technology is necessary which is capable of effectively controlling a rapid temperature increase in the electron beam irradiation surface 16 with small area.

However, there is a limitation in providing the anode target 14 capable of tolerating an electron beam that generates an X-ray of high resolution and high dose only by selecting a material or controlling the structure of the anode target 14. Accordingly, short-pulse driving of the X-ray source according to an embodiment of the inventive concept is required.

Figure 2A:
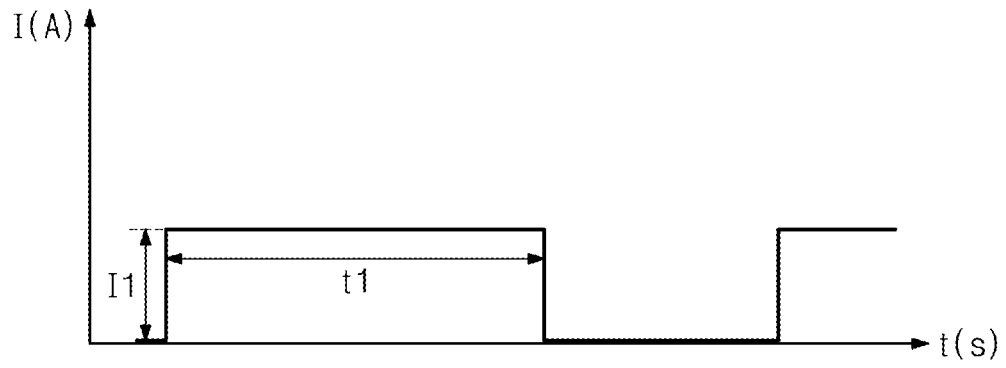
FIG. 2A is a drawing for explaining long-pulse driving of an X-ray source device according to an embodiment of the inventive concept.

FIG. 2A is a drawing for explaining long-pulse driving of an X-ray source device according to an embodiment of the inventive concept.

Referring to FIG. 2A, for the long-pulse driving of the X-ray source device, an electron beam is continuously irradiated towards the electron beam irradiation beam 16 from the electron source 12 for a prescribed long-pulse duration time t1. For the long-pulse duration time t1, the long-pulse electron beam may have a prescribed long-pulse current magnitude I1. For the long-pulse driving, the long-pulse duration time t1 may be repeated in plurality.

Figure 2B:
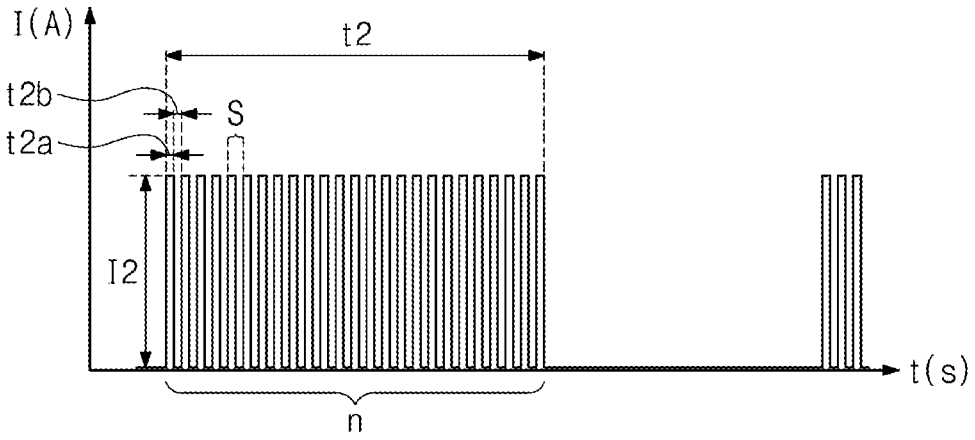
FIG. 2B is a drawing for explaining short-pulse driving of an X-ray source device according to an embodiment of the inventive concept.

FIG. 2B is a drawing for explaining short-pulse driving of an X-ray source device according to an embodiment of the inventive concept.

Referring to FIG. 2B, for the short-pulse driving of the X-ray source device, a main pulse duration time t2 may be repeated in plurality. In other words, an electron beam may be provided with a plurality of main pulses. Each of the main pulses may include a plurality of short pulses S having a pulse time t2a and an idle time t2b, each of the pulse time t2a and the idle time t2b is shorter than the main pulse duration time t2. For the pulse time t2a, the electron beam may be irradiated towards the electron beam irradiation surface 16 from the electron source 12, and for the idle time t2b, the electron beam may not be irradiated towards the electron beam irradiation surface 16 from the electron source 12. The electron beam may idle during the idle time. In other words, the short-pulse may be applied for the pulse time t2a and the idle time t2b. For the main pulse duration time t2, the application of the short-pulse may be repeated as many as the number of the short-pulse repetitions n, where n is an integer of 1 or greater. For the pulse time t2a, the electron beam of the short pulse S may have a prescribed short-pulse current magnitude I2. For example, the pulse time t2a and the idle time t2b may be several nanoseconds (ns) to several seconds (s).

$$d=t2a/(t2a+t2b) \tag{4}$$

Referring to Equation (4), a short pulse duty cycle d may be calculated by the pulse time t2a and the idle time t2b. Namely, the short pulse duty cycle d may be a value obtained by dividing the idle time t2b of the short pulse S by a sum of the pulse time t2a and the idle time t2b.

$$I2=m/t2a=M/(t2a\cdot n)=(t1\cdot I1)/(t2a\cdot n)=(t1\cdot I1)/(t2a\cdot t1\cdot d/t2a)=I1/d \tag{5}$$

Equation (5) may explain relationships among the short-pulse current magnitude I2, a dose per short-pulse m, the pulse time t2a, the X-ray requirement dose M, the number of short-pulse repetitions n, the long-pulse duration time t1, the long-pulse current magnitude I1, and the short-pulse duty cycle d.

The X-ray source device is required to satisfy an X-ray dose requirement M according to a property of an object irradiated with the X-ray and a required image resolution.

For the long-pulse driving of FIG. 2A, the X-ray dose requirement M may be satisfied by continuously irradiating the electron beam with the prescribed long-pulse current magnitude I1 for the prescribed long-pulse duration time t1.

For the short-pulse driving of FIG. 2B, the dose per short-pulse m may be obtained by irradiating the electron beam with the prescribed short-pulse current magnitude I2 for the pulse time t2a. The X-ray dose requirement M may be satisfied by multiplying the dose per short-pulse m by the number of short-pulse repetitions n. In other words, for the short-pulse driving, the X-ray dose requirement M may be satisfied by discontinuously irradiating the electron beam.

Consequently, for the short-pulse driving, in order to satisfy the X-ray dose requirement M within the main pulse duration time t2 having the same length as the long-pulse duration time t1, short-pulse driving conditions such as the short-pulse current magnitude I2, the pulse time t2a, the number of short-pulse repetitions n, and the short-pulse duty cycle d may be properly determined. In this case, the short-pulse current magnitude I2 may be obtained by dividing the long-pulse current magnitude I1 by the short-pulse duty cycle d.

For example, when the X-ray dose requirement M is 0.2 mAs, the long-pulse driving may satisfy the X-ray dose requirement M by irradiating the electron beam with the long-pulse current magnitude I1 of 20 mA for the long-pulse duration time t1 of 0.01 s.

In this case, the short-pulse driving may satisfy the X-ray dose requirement M by irradiating the electron beam with the short-pulse current magnitude I2 of 40 mA for the pulse time t2a of 0.00005 s and the number of short-pulse repetitions n of 100.

On the other hand, for the short-pulse driving, the thermal energy E transferred on the electron beam irradiation surface 16 may be calculated by multiplying the electron beam acceleration voltage V by the short-pulse current magnitude I2, the pulse time t2a, and the number of short-pulse repetitions n.

Figure 3:
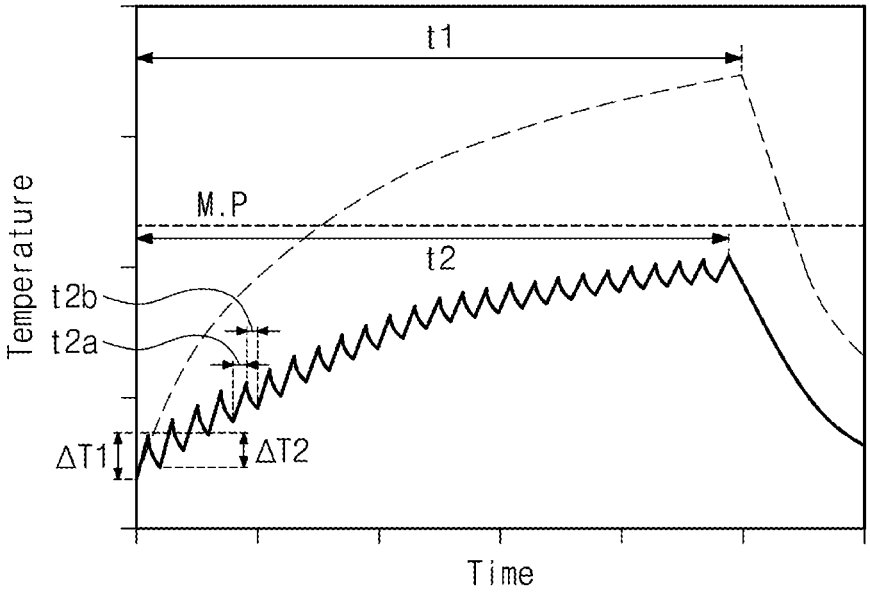
FIG. 3 is a drawing for explaining temperature rise on an electron beam irradiation surface according to long-pulse and short-pulse driving.

FIG. 3 is a drawing for explaining a temperature rise of the electron beam irradiation surface according to the long-pulse and short-pulse driving.

In FIG. 3, the dashed line denotes the temperature rise of the electron beam irradiation surface according to the long-pulse driving, and the solid line denotes the temperature rise of the electron beam irradiation surface according to the short-pulse driving.

Referring to FIG. 3, for the long-pulse driving, the temperature of the electron beam irradiation surface 16 may continuously rise for the long-pulse duration time t1. In this case, there may occur a case where the temperature of the electron beam irradiation surface 16 exceeds the melting point M.P of the anode target 14 according to properties such the thermal capacity C and the thermal diffusivity α, the thermal energy E transferred by the electron beam to the anode target 14, or the area of the electron beam irradiation surface 16. Accordingly, the X-ray source device may be damaged.

For the short-pulse driving, the temperature of the electron beam irradiation surface 16 may rise and fall. In other words, for the pulse time t2a, the temperature of the electron beam irradiation surface 16 may rise, and for the idle time t2b, the temperature of the electron beam irradiation surface 16 may fall. The temperature increase ΔT1 of the electron beam irradiation surface 16 for the pulse time t2a and the temperature decrease ΔT2 of the electron beam irradiation surface 16 for the idle time t2b may be determined by the transferred thermal energy E, the thermal capacity C of the anode target 14, the thermal diffusivity α of the anode target 14, or the area of the electron beam irradiation surface 16.

Since the thermal capacity C and the thermal diffusivity α of the anode target 14 may be differed according to the temperature, the temperature increase ΔT1 and the temperature decrease ΔT2 may be differed according to a time. For example, as illustrated in FIG. 3, within the main pulse duration time t2, a difference between the temperature increase ΔT1 and the temperature decrease ΔT2 may be gradually reduced according to the time. For example, the difference between the temperature increase ΔT1 and the temperature decrease ΔT2 may be reduced by 5% or lower of the melting point (in absolute temperature) of the anode target 14. As the difference between the temperature increase ΔT1 and the temperature decrease ΔT2 reduces, the temperature of the electron beam irradiation surface 16 may not exceed a specific temperature. Accordingly, the electron beam irradiation surface 16 may not exceed the melting point of the material of the anode target 14.

In order that the difference between the temperature increase ΔT1 and the temperature decrease ΔT2 is gradually reduced according to the time, a suitable short-pulse duty cycle d may be necessary. For example, when the short-pulse duty cycle d is 0.6 or smaller, the idle time t2b is sufficiently long and the difference between the temperature increase ΔT1 and the temperature decrease ΔT2 may be gradually reduced according to time.

However, when the main pulse duration time t2 is fixed and the short-pulse duty cycle d is excessively small, the short-pulse current magnitude I2 may be increased to satisfy the X-ray dose requirement M. When the short-pulse current magnitude I2 is increased, even when the idle time t2b is sufficiently long, the difference between the temperature increase ΔT1 and the temperature decrease ΔT2 may not be gradually reduced according to time. Accordingly, the short-pulse duty cycle d is required to be 0.4 or greater in order to prevent an increase of the short-pulse current magnitude I2.

Consequently, a range of the short-pulse duty cycle d for the proper idle time t2b and short-pulse current magnitude I2 may be about 0.4 to about 0.6. In the range of the short-pulse duty cycle d, the difference between the temperature increase ΔT1 and the temperature decrease ΔT2 may be gradually reduced according to time, and the temperature of the electron beam irradiation surface 16 may not exceed the melting point of the material of the anode target 14. In the range of the short-pulse duty cycle d, conditions such as the short-pulse current magnitude I2, the pulse time t2a, the idle time t2b, and the number of short-pulse repetitions n may be optimized. For example, the pulse time t2a and the idle time t2b may be several nanoseconds (ns) to several seconds (s).

As described above, through the short-pulse driving of the X-ray irradiation device according to an embodiment of the inventive concept, the temperature of the electron beam irradiation surface 16 is prevented from exceeding the melting point of the anode target 14, while satisfying the X-ray dose requirement M and not enlarging the size of the anode target 14.

For the short-pulse driving according to the inventive concept, the electron source 12 is required which capable of controlling electron emission in several nanoseconds (ns) to several seconds (s).

Referring to FIG. 1, the X-ray irradiation device according to the inventive concept may form an electric field between the gate electrode 13 and the electron source 12 through a gate voltage control of the gate electrode 13. By the electric field between the gate electrode 13 and the electron source 12, an electron beam may be emitted from the electron source 12. Accordingly, by controlling the gate voltage, the electron beam emission may be controlled in several nanoseconds (ns) to several seconds (s). In this case, the gate voltage applied to the gate electrode may be within several kV, and this may be very small in comparison to the electron beam acceleration voltage V. Accordingly, the acceleration of the electron beam by the gate voltage of the gate electrode 13 does not matter in the short pulse driving.

Even in a state where a continuous DC gate voltage is applied to the gate electrode 13, the electron beam emission may be directly controlled by using a transistor connected to the cathode electrode 11. By controlling the gate voltage of the transistor, the electron beam emission may be controlled in a several nanoseconds (ns) to several seconds (s).

According to a method for driving an X-ray source according to an embodiment of the inventive concept may prevent a temperature of an electron beam irradiation surface from being exceeding a melting point of an anode target and meet an X-ray dose requirement.

Although an embodiment of the present disclosure has been described with reference to the accompanying drawings, it should be understood that those skilled in the art can carry out other modifications without changing its technical spirit or essential features. Therefore, the above-described embodiment of the present disclosure is merely exemplary in all aspects and should not be construed to be limited.

The above-disclosed subject matter is to be considered illustrative and not restrictive, and the appended claims are intended to cover all such modifications, enhancements, and other embodiments, which fall within the true spirit and scope of the inventive concept. Thus, to the maximum extent allowed by law, the scope of the inventive concept is to be determined by the broadest permissible interpretation of the following claims and their equivalents, and shall not be restricted or limited by the foregoing detailed description.

What is claimed is:

1. A method for driving an X-ray source, which comprises a cathode electrode, an electron source provided on the cathode electrode and configured to emit an electron beam, an anode target comprising an electron beam irradiation surface with the electron beam irradiated thereto, the method comprising:

providing the electron beam in a plurality of main pulses, wherein each of the main pulses comprises a plurality of short pulses having an idle time and a pulse time, and each of the idle time and the pulse time is shorter than a duration time of the main pulse, wherein applying the plurality of short pulses comprises:

irradiating the electron beam from the electron source towards the electron beam irradiation surface during the pulse time; and idling the electron beam during the idle time, wherein a duty cycle of the short pulse is 0.4 to 0.6 where the duty cycle is obtained by dividing the idle time by a sum of the pulse time and the idle time, wherein the X-ray source device further comprises a gate electrode including an opening at a position corresponding to the electron source and a transistor connected to the cathode electrode, and wherein the method further comprises controlling emission of the electron beam in several nanoseconds (ns) to several seconds by applying a continuous DC voltage to the gate electrode and applying the plurality of short pulses to a transistor gate.

2. The method of claim 1, wherein the pulse time is several nanoseconds (ns) to several seconds (s).

3. The method of claim 1, wherein in the duration time of the main pulses, a difference between a temperature increase of the electron beam irradiation surface during the pulse time and a temperature decrease of the electron beam irradiation surface during the idle time is 5% or lower of a melting point (in absolute temperature) of the anode target.

4. The method of claim 1, wherein the anode target comprises copper (Cu) or silver (Ag).

5. The method of claim 1, wherein the anode target comprises tungsten (W), molybdenum (Mo), chromium (Cr), tantalum (Ta), or rhenium (Re).

* * * * *